US006698108B2

(12) United States Patent
Pavelescu et al.

(10) Patent No.: US 6,698,108 B2
(45) Date of Patent: Mar. 2, 2004

(54) WATERPROOF SHOE

(75) Inventors: Liviu Pavelescu, Wuppertal (DE); Karsten Keidel, Wuppertal (DE); Manfred Haderlein, Hann (DE); Harry Van De Ven, Arnehm (NL); John J. Mulcahy, Rochester, NH (US)

(73) Assignee: Sympatex Technologies GmbH, Wuppertal (DE)

( * ) Notice: Subject to any disclaimer, the term of this patent is extended or adjusted under 35 U.S.C. 154(b) by 47 days.

(21) Appl. No.: 10/047,699

(22) Filed: Jan. 18, 2002

(65) Prior Publication Data

US 2002/0066210 A1 Jun. 6, 2002

Related U.S. Application Data

(63) Continuation-in-part of application No. 09/730,398, filed on Dec. 6, 2000, now abandoned.

(51) Int. Cl.[7] ..... A43B 23/07
(52) U.S. Cl. ..... 36/45; 36/55
(58) Field of Search ..... 36/10, 55, 45

(56) References Cited

U.S. PATENT DOCUMENTS

| | | | | | |
|---|---|---|---|---|---|
| 2,178,629 | A | | 11/1939 | Everston | |
| 2,619,741 | A | * | 12/1952 | Clark | 36/109 |
| 3,110,117 | A | * | 11/1963 | Ruebel | 36/93 |
| 4,430,811 | A | * | 2/1984 | Okada | 36/45 |
| 4,819,345 | A | | 4/1989 | Mulcahy et al. | |
| 5,253,434 | A | | 10/1993 | Curley, Jr. et al. | |
| RE34,890 | E | | 4/1995 | Sacre | |
| 5,499,459 | A | * | 3/1996 | Tomaro | 36/10 |
| 5,505,011 | A | * | 4/1996 | Bleimhofer | 36/4 |
| 5,678,326 | A | * | 10/1997 | Pavelescu | 36/14 |
| 5,711,093 | A | * | 1/1998 | Aumann | 36/77 R |
| 5,732,429 | A | | 3/1998 | Strickland | |
| 5,732,479 | A | | 3/1998 | Pavelescu | |
| 5,802,740 | A | * | 9/1998 | Merk, Sr. | 36/55 |
| 5,918,382 | A | | 7/1999 | Haderlein et al. | |
| 5,930,917 | A | | 8/1999 | Pavelescu et al. | |
| 5,933,897 | A | | 8/1999 | Macdonald | |
| 5,943,791 | A | | 8/1999 | Pavelescu et al. | |
| 5,964,047 | A | * | 10/1999 | Covatch | 36/55 |
| 5,983,524 | A | | 11/1999 | Polegato | |
| 6,035,555 | A | | 3/2000 | Pavelescu et al. | |
| 6,088,935 | A | | 7/2000 | Pavelescu et al. | |
| 6,260,288 | B1 | * | 7/2001 | Barthelemy et al. | 36/3 R |
| 6,412,193 | B1 | | 7/2002 | Chen | |

FOREIGN PATENT DOCUMENTS

| | | |
|---|---|---|
| EP | 0 665 259 | 8/1995 |
| WO | WO 95/30793 | 11/1995 |

* cited by examiner

*Primary Examiner*—M. D. Patterson
(74) *Attorney, Agent, or Firm*—Oliff & Berridge, PLC

(57) ABSTRACT

Waterproof, water vapor permeable shoe construction including an exterior upper, a waterproof, water vapor permeable functional-layer upper, a lining upper, and a sole. Both the waterproof, water vapor permeable functional-layer upper and the lining upper are in the shape of a sock and introduced separately into the shoe. The functional-layer upper and lining upper are preferably joined to the exterior upper only at a top opening of the shoe construction through which a foot is inserted. The functional-layer upper can be composed of individual pieces that are joined together by seams that are sealed, or it can be seamless. The method for manufacturing the waterproof, water vapor permeable shoe has the steps of manufacturing a exterior upper; manufacturing a waterproof, water vapor permeable functional-layer upper in the shape of a sock; manufacturing a lining upper in the shape of a sock; inserting the functional-layer upper into the exterior upper; inserting the lining upper into the functional-layer upper; and applying a sole from underneath.

22 Claims, 3 Drawing Sheets

WATERPROOF SHOE

This is a continuation-in-part of application Ser. No. 09/730,398 filed Dec. 6, 2000 now abandoned.

BACKGROUND OF THE INVENTION

The invention relates to a waterproof, water vapor permeable shoe construction including an exterior upper, a waterproof, water vapor permeable functional-layer upper, a lining upper, and a sole, as well as to a method for manufacturing a waterproof shoe.

DESCRIPTION OF THE RELATED ART

Shoe constructions of this type are well known. For example, U.S. Pat. No. Re 34,890 describes a shoe construction having an exterior upper and a sock-shaped lining, with the lining consisting of a three-layer laminate. This laminate is used to make the shoe structure waterproof and water vapor permeable and typically contains a functional layer giving the laminate a waterproof, water vapor permeable property and other layers of other material, such as textile layers.

The manufacture of waterproof, water vapor permeable shoe constructions using laminates is very complex, because production of the three-dimensional shoe form from two-dimensional laminates can be done only by cutting them into shaped pieces and then joining the pieces, preferably by sewing, after which the joints, the seams in the case of sewing, must then be sealed in order to restore the waterproof quality of the three-dimensional structure produced in this manner.

In the embodiment known from U.S. Pat. No. Re 34,890, a sock-shaped, three-dimensional structure is formed from the laminate, the structure then being inserted into the exterior upper. This sock-shaped, three-dimensional structure can be produced from the two-dimensional laminate only by using multiple seams. Each individual seam must then be sealed in order to render the sock-shaped, three-dimensional structure waterproof.

A laminate can be produced, for example, by gluing together the individual layers that are to form the laminate, such as a first functional layer and at least one second layer. The functional layer is waterproof and water vapor impermeable, while the remaining layers, which normally are textile fabrics such as woven or knitted fabrics, are water vapor permeable but not waterproof. If the various layers are now glued together over their entire surface, the full-surface adhesive hinders the water vapor permeability of the functional layer, so that the finished laminate has reduced water vapor permeability compared to the functional layer. For this reason, such laminates are frequently produced by joining the individual layers at distributed points. However, with this method the number of gluing points is still high enough that a reduction of the water vapor permeability of the laminate compared to the functional layer alone is noted in this case as well.

It is often difficult to ensure the tightness of the required seams, even if the seams are sealed afterwards, because each seam and also the threads of the textile fabric can transport water into the interior via capillary action. Moreover, it must be ensured that the sealing material penetrates the textile fabric up to the functional layer, since the joints of the shaped functional-layer pieces, which are arranged behind the textile fabric as seen from the sealing side, must be sealed, and this is not always completely successful. Furthermore, the strain involved when the shoe construction is worn can loosen the seam seal, so that the waterproof quality cannot be guaranteed at these locations.

In the aforementioned methods of manufacturing waterproof, water vapor permeable shoe constructions, it is also necessary to form from the laminate a three-dimensional structure adapted to each respective shoe size. This also increases production costs.

A further problem is that the constructions used up to now to manufacture waterproof, water vapor permeable shoes are different from the shoe constructions used for other shoes. The resulting variety of designs makes mass production very expensive.

SUMMARY OF THE INVENTIONS

The object of the present invention is to provide a shoe construction as initially described, in which the aforementioned problems are at least reduced.

The object is achieved with a waterproof, water vapor permeable shoe construction including an exterior upper, a waterproof, water vapor permeable functional-layer upper, a lining upper, and a sole, in that both the waterproof, water vapor permeable functional-layer upper and lining upper are sock-shaped and inserted separately into the shoe.

According to the invention, the term "inserted separately" means that the functional-layer upper and lining upper are produced separately in manufacturing the shoe construction of the invention and not combined until the shoe construction of the invention is manufactured. The functional layer and lining are thus not combined as a laminate to form an upper. This characteristic is also clearly observable from the completed shoe construction.

If the functional-layer upper is sewn together from shaped pieces, it is evident that the seam is arranged only in and on the functional layer. The lining upper can be produced by form knitting, for example, and in this case has no seams. If the lining upper is like-wise sewn together from shaped pieces, these seams are joined only to the material of the lining upper. There is thus no single seam that joins both the shaped pieces of the lining upper and those of the functional-layer upper.

In the case of seamless functional-layer uppers, it is also clearly observable that the functional-layer upper and lining upper were previously separate, since, even when the two uppers have been joined together, it is evident that the joining of the two uppers can only have been accomplished after producing them separately.

The separate insertion of the functional-layer upper and lining upper into the exterior upper also allows simple use of the construction designed for manufacturing waterproof, water vapor permeable shoes to make other shoes unrelated to the invention, by omitting the functional-layer upper during production. In this way, the type variety on the part of the shoe manufacturers can be reduced considerably.

The shoe construction of the invention can be produced especially economically if the functional-layer upper and lining upper are joined to the exterior upper only at a top opening of the shoe construction through which a foot is inserted. As a result, the shoe structure of the invention is considerably easier to repair. Since the functional-layer upper and lining upper are joined to the exterior upper only at the top opening, the functional-layer upper and lining upper can be withdrawn from the interior of the shoe before repairs are undertaken on the remainder of the shoe structure, without endangering the functional-layer upper, which is generally sensitive and thin. The functional-layer upper can also be replaced easily if its waterproof quality is impaired, since only a single joint with the exterior upper must be renewed.

For the joining at the top opening, it is especially practical to fold the exterior upper over the functional-layer upper and lining upper at the upper opening, in order to form the joint between the functional-layer and lining uppers.

DESCRIPTION OF PREFERRED EMBODIMENTS

Figure 1:
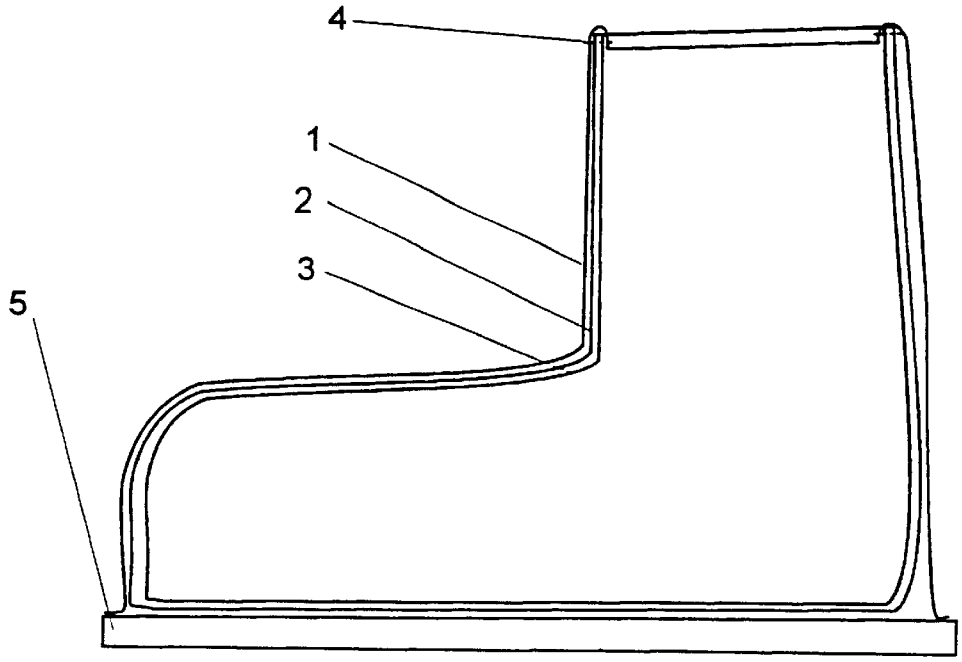
FIG. 1 shows the cross-section of a shoe of the invention.

The shoe construction of the invention is characterized in that the functional-layer upper is comprised of individual pieces that are joined by seams and the seams are sealed.

Separate insertion of the functional-layer and lining uppers into the shoe allows particular care to be taken in forming the sock shape of the functional-layer upper. If the sock shape of the functional-layer upper is produced from a plane, two-dimensional functional layer, the individual pieces cut out from the functional layer can be joined together considerably more easily. The joining of the pieces can quite easily be accomplished by gluing or heat sealing. Joining of the shaped pieces can also be effected by sewing, making subsequent sealing considerably less problematical, since there is no textile structure present on the functional layer, a factor that impedes sealing of the seams in the case of laminates. Furthermore, the adhesive used in sealing these seams need only be adapted to one material, that of the functional layer, considerably simplifying the promotion of a permanent seal.

It is particularly advantageous if the functional-layer upper is seamless. To effect this, the functional-layer upper of the shoe construction of the invention can be formed directly in a sock shape, i.e., three-dimensionally, and exhibit no seams or other joints. Such a functional-layer upper can be manufactured for example using the method described in EP 0 665 259 A1, according to which three-dimensional articles are produced by coating at least once a three-dimensional form with an aqueous dispersion of a copolyether ester, similar to latex dispersions in the rubber industry, in order to produce a film after expulsion of water, such as by heating, the film then being removed from the form. To produce a shoe construction of the invention, the form used to manufacture the functional-layer upper has the three-dimensional shape of a sock or the outer contour of a foot.

In this regard, the shoe construction of the invention is characterized in particular in that the functional-layer upper is manufactured by coating a foot-shaped form with a polymer-containing dispersion or solution and then transforming the polymer into a film.

To reduce the number of functional-layer uppers required for various shoe sizes in the shoe construction of the invention in the case of seamless functional-layer uppers, it has proven particularly advantageous if an initially seamless functional-layer upper is cut open in the sole area and the cut edges are joined by a seam.

By drawing together the cut edges to varying degrees prior to sewing them together, different sizes of the functional-layer upper can be obtained. The cut edges protruding beyond the seam can be cut off or otherwise removed before or after sewing.

It is also possible to cut open the underside of the functional-layer upper and insert an insole, which is then joined to the functional-layer upper and thus becomes part of it.

To stabilize the functional-layer upper in the sole area, it has proven advantageous for the functional-layer upper to be joined to an insole.

In this case, the functional-layer upper can be joined to the insole via a seam. As previously noted, such a seam can be readily sealed, because the functional-layer upper is inserted separately from the lining upper and the textile structure forming the lining upper thus does not interfere with the sealing.

It is of particular advantage in this case for the seams produced on the functional-layer upper to be sealed by coating with a dispersion or solution containing a waterproof polymer. Dispersions or solutions penetrate readily into the holes formed by the sewing seams in the insole and functional layer and into the capillaries contained in the seams, so that a good seal results after the polymer contained in this dispersion or solution has hardened.

Particularly good results are obtained in this case if the polymer contained in the dispersion or solution is selected from the same group as the polymer from which the functional-layer upper is manufactured.

It is especially advantageous in this case for the polymer contained in the dispersion or solution to be waterproof and water vapor permeable after coating.

To the extent desired, the functional-layer upper can be joined to the lining upper. The joint formed by the functional-layer upper with the lining upper can be separable, but it can also be achieved via a plurality of gluing points with the lining upper. It has proven especially beneficial if the gluing points can be activated by heat. The gluing points can be applied in a particularly simple manner to the lining upper or the folded-over inside of the functional-layer upper, before the latter is inserted into the shoe construction. The functional-layer upper can be joined to the exterior upper in the same manner. The lining upper is then joined to the functional-layer upper or the functional-layer upper to the exterior upper by subsequent application of heat in the form of air or a hot last.

The shoe construction of the invention is also characterized in that the functional-layer upper is joined to the sole; in this case, it is especially practical for the functional-layer upper, exterior upper, and sole to be joined together.

It is advantageous in this case for the functional-layer upper, exterior upper, and sole to be joined by a seam and the seam to be sealed.

Alternatively, the shoe construction of the invention is characterized in that the exterior upper and functional-layer upper are joined to an injection-molded sole.

The object of the invention is also achieved by a method for manufacturing a waterproof, water vapor permeable shoe, characterized by the following steps:

manufacturing the exterior upper, manufacturing a waterproof, water vapor permeable functional-layer upper in the shape of a sock, manufacturing a lining upper in the shape of a sock, inserting the functional-layer upper into the exterior upper, inserting the lining upper into the functional-layer upper, applying the sole from underneath.

Insertion of the lining upper into the functional-layer upper can also take place outside the exterior upper; the functional-layer upper is then inserted into the exterior upper together with the lining upper.

It can be advantageous in this case for the inside of the functional-layer upper or outside of the lining upper to have gluing points, via which the functional-layer upper is joined to the lining upper after inserting the functional-layer upper into the exterior upper and the lining upper into the functional-layer upper.

Figure 2:
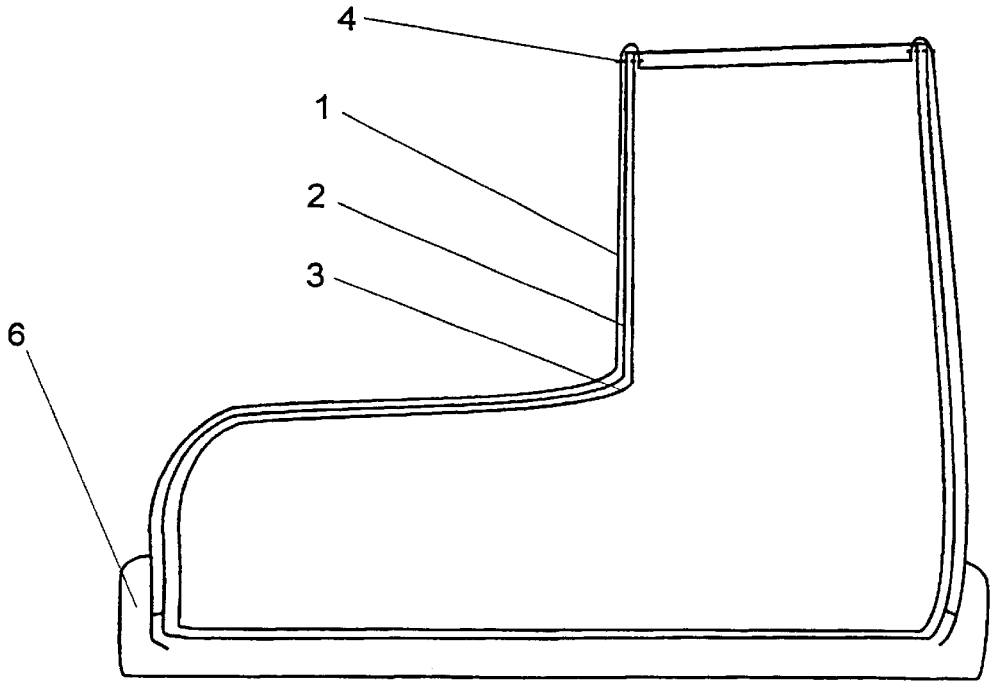
FIG. 2 shows the cross-section of a shoe of the invention with an injection-molded outsole.

According to FIG. 1, the shoe construction of the invention consists of an exterior upper 1, a functional-layer upper 2, a lining upper 3, and a sole 5, which in the construction illustrated in FIG. 1 is a glued-on outsole and in FIG. 2 is an injection-molded outsole. The functional-layer upper 2 is situated between the exterior upper 1 and lining upper 3.

In the shoe structure of the invention, the top edge of exterior upper 1 can be folded over the top edges of functional-layer upper 2 and lining upper 3 and sewn via seam 4. A preferred construction of the shoe structure of the invention is characterized in that seam 4 is the only connection between the functional-layer upper and lining upper. This construction can be produced in a particularly economical manner.

On the underside, the exterior upper is joined to an outsole 5, preferably by gluing or sewing. The adjacent areas of the functional-layer upper 2 or outsole 5 can be joined to each other by adhesives or seams, for example. If the functional-layer upper 2 is sewn to the outsole 5, care must be taken to seal the seam, as previously described.

According to FIG. 2, an injection-molded shoe sole 6 is used in a shoe construction of the invention. In this case, the material used to produce the injection-molded sole seals all seams in the vicinity of the sole and also penetrates into the spaces between the exterior upper 1 and functional-layer upper 2 or other cavities produced during manufacture. In this manner, the lower area of the shoe structure is rendered waterproof. In this case, including that when the underside of the functional-layer upper 2 is cut open and then sewn together, the resulting seam of the functional-layer upper is sealed by the sole material.

Such seams in the functional-layer upper also do not disturb the wearer of the shoe, since the functional-layer upper is generally constructed from a very thin functional layer with a thickness between 10 and 150 $\mu$m, for example, so that folds and seams do not protrude significantly and are accommodated by the lining upper.

The materials from which exterior upper 1, functional-layer upper 2, and lining upper 3 are produced are generally known in the art. A list of such materials can be found in U.S. Pat. No. 5,678,236, for example.

The exterior upper can, for example, be made of leather, leatherette, textiles, woven fabrics, canvas, chintz, terry, velvet, Manchester velvet, corduroy, velveteen, muslin, satin, fur, or similar materials.

The lining upper can, for example, be made of terry, goatskin, sheepskin, cowhide, pigskin, velvet, camel hair, woven fabric, knitted or woven material, cotton, wool, synthetic fibers, or cellulosic material.

The outsole should be made from a waterproof material such as rubber, polyurethane, polyvinyl chloride or a derivative thereof, or from blends of these materials.

The functional-layer upper consists of a waterproof, water vapor permeable material and can be produced, for example, from polymers capable of forming a microporous polymer matrix, as described for example in U.S. Pat. No. 5,732,479. However, other materials are possible that are non-porous but waterproof and water vapor permeable. Suitable polymers for this are polyolefins, polyethylene-propylene copolymers, polyethylene, terephthalate, polycaprolactam, polyvinylidene fluoride, polybutylene terephthalate, polyester copolymers, polytetrafluoroethylene, and copolyether ester. The material of the functional-layer upper, however, can also have a plurality of layers of different polymers. For example, a porous polytetrafluoroethylene film can have a second layer of polyurethane.

If the functional-layer upper is produced by coating a form, a multi-layer functional-layer upper can also be produced in this case by initially coating the form with a polymer-containing dispersion or solution, hardening the polymer, then coating the resulting film with a dispersion or solution containing a second polymer, hardening this polymer, and so on. A simple manner of coating a form is to immerse the form in the dispersion or solution. If the coating is too thin, the form can be immersed more than once until the coat on the form has the desired thickness. The preferred thickness for the functional layer is from 10 to 150 $\mu$m, and preferably from 40 to 100 $\mu$m.

A functional-layer upper made from copolyether ester, a material known under the trademark SYMPATEX, is excellently suited for the shoe construction of the invention.

Figure 3:
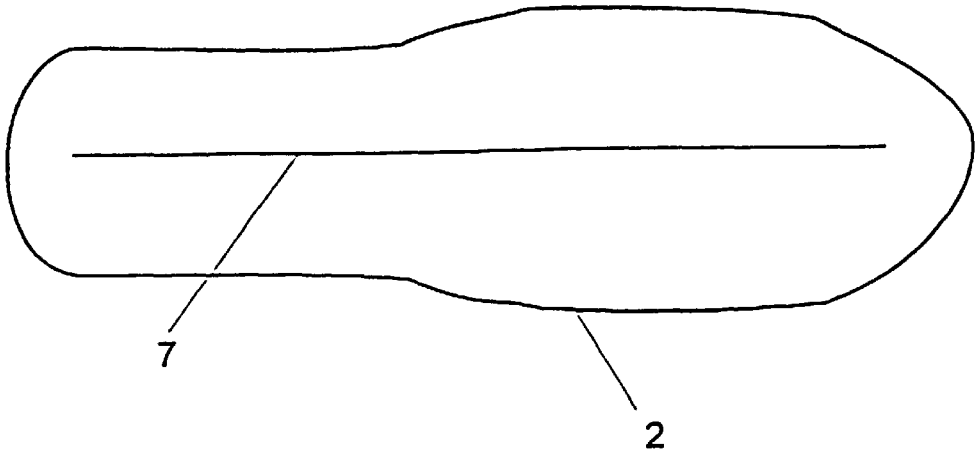
FIG. 3 shows a view from below of a functional-layer upper that has been cut open and sewn together again.
Figure 4:
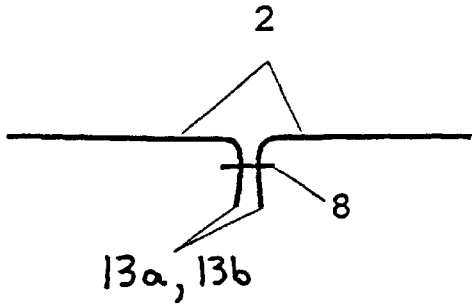
FIG. 4 shows a section of the functional-layer upper cut open and sewn together again in accordance with FIG. 3.

According to FIG. 3, a functional-layer upper 2 is illustrated from below that has been cut open along line 7. As shown in FIG. 4, the cut edges 13*a* and 13*b* have been sewn via seam 8. The cut edges, however, can also be joined by gluing. If the cut edges are too long, they can be shortened in a simple manner by cutting. In this simple way, it is possible to readily adapt the functional-layer upper to different shoe sizes.

Figure 5:
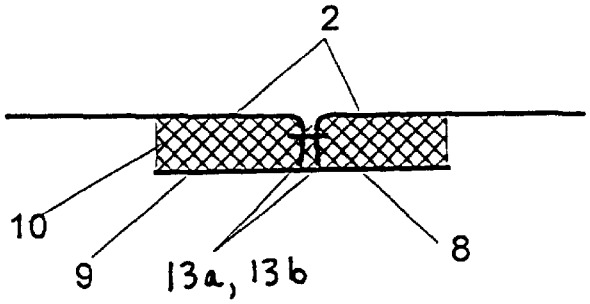
FIG. 5 shows the section of FIG. 4 in which the seam has been sealed by an adhesive on a tape.

FIG. 5 shows, on the basis of a seam according to FIG. 4, how such a seam can be sealed effectively by having the adhesive encompass the cut edges 13*a* and 13*b*, thus closing any gap that might exist between them. The adhesive can be covered by a tape 9. In processing waterproof, water vapor permeable functional layers, adhesive tapes have proven advantageous that consist of a tape and a polymer layer applied thereon, with the polymer layer becoming fluid on application of heat and functioning as a tight adhesive. The adhesive tapes can be readily applied to the seam using an iron, for example.

Figure 6:
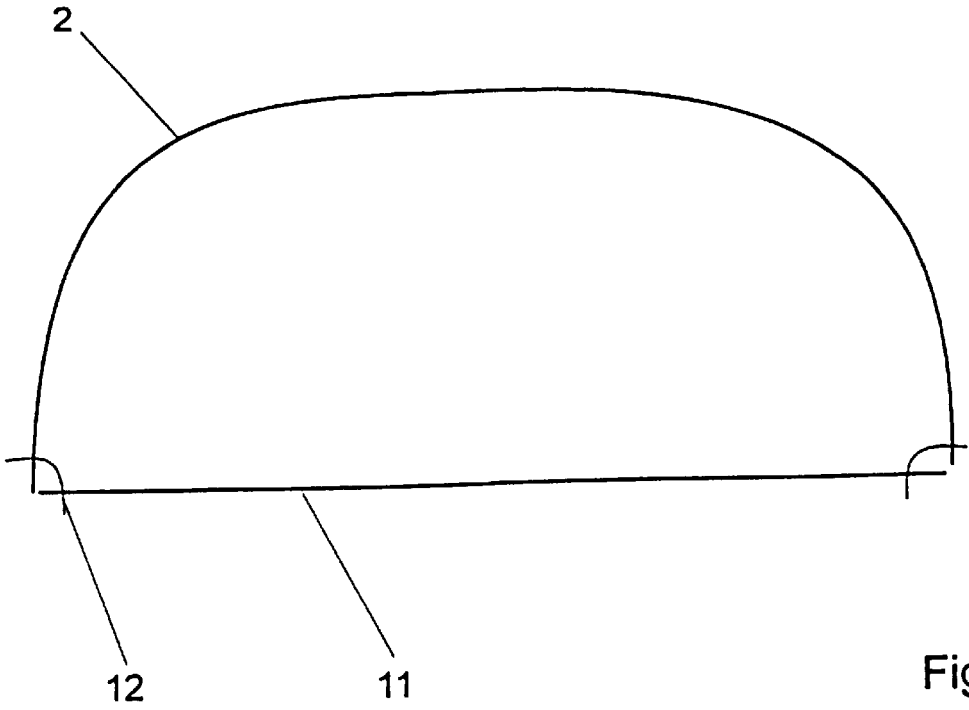
FIG. 6 shows the cross-section of a shoe in which the lower part of a functional-layer upper has been removed and replaced by an insole.

In another embodiment, according to FIG. 6, the sole area of the functional-layer upper has been cut out and replaced by an insole 11. The insole 11 is joined to the functional-layer upper via a seam 12, so that in this embodiment the functional layer 2 forms the functional-layer upper together with the insole. If the waterproof quality is also required in the area of the insole, the insole can be made from a waterproof and possibly water vapor permeable material. In this case, seam 12 should also be sealed in a waterproof manner. In this way as well, it is possible to adapt the functional-layer upper to different shoe sizes by using insoles of different sizes.

What is claimed is:

1. A waterproof, water vapor permeable shoe construction comprising an exterior upper, a waterproof, water vapor permeable functional-layer upper, a lining upper comprised of shaped individual pieces sewn together at seams, and a sole, wherein both the waterproof, water vapor permeable functional-layer upper and the lining upper are in the shape of a sock and introduced separately into the shoe such that the seams of the lining upper that join the shaped individual pieces of the lining upper join only the shaped individual pieces of the lining upper and do not join the lining upper with the functional-layer upper.

2. The shoe construction according to claim 1, wherein the functional-layer upper and lining upper are joined to the exterior upper only at a top opening of the shoe construction through which a foot is inserted.

3. The shoe construction according to claim 1, wherein the exterior upper at a top opening is folded over the functional-layer upper and lining upper in order to form a joint of the functional-layer upper and lining upper.

4. The shoe construction according to claim 1, wherein the functional-layer upper is composed of individual pieces that are joined via seams and the seams are sealed and wherein the seams of the functional-layer upper that join the individual pieces of the functional-layer upper join only the individual pieces of the functional-layer upper and do not join the functional-layer upper with the lining upper.

5. The shoe construction according to claim 1, wherein the functional-layer upper is seamless.

6. The shoe construction according to claim 5, wherein the seamless functional-layer upper is formed by a foot-shaped form dipped into a polymer-containing dispersion or solution.

7. The shoe construction according to claim 1, wherein an initially seamless functional-layer upper is cut open in the sole area and the cut edges are joined via a seam.

8. The shoe construction according to claim 1, wherein the functional-layer upper is joined to an insole.

9. The shoe construction according to claim 8, wherein the functional-layer upper is joined to the insole via a seam.

10. The shoe construction according to claim 9, wherein the seams are sealed with a coating comprising a dispersion or solution containing a waterproof polymer.

11. The shoe construction according to claim 10, wherein the waterproof polymer contained in the dispersion or solution and a polymer of the functional-layer upper are selected from the same group.

12. The shoe construction according to claim 11, wherein the polymer contained in the dispersion or solution is waterproof and water vapor permeable after coating.

13. The shoe construction according to claim 1, wherein the functional-layer upper is joined to the lining upper.

14. The shoe construction according to claim 13, wherein the functional-layer upper is joined to the lining upper in a separable manner.

15. The shoe construction according to claim 13, wherein the functional-layer upper is joined to the lining via a plurality of gluing points.

16. The shoe construction according to claim 15, wherein the gluing points are comprised of a glue activatable by heat.

17. The shoe construction according to claim 1, wherein the functional-layer upper is joined to the sole.

18. The shoe construction according to claim 17, wherein the functional-layer upper, exterior upper, and sole are joined together.

19. The shoe construction according to claim 18, wherein the functional-layer upper, exterior upper, and sole are joined via a seam and the seam is sealed.

20. The shoe construction according claim 1, wherein the exterior upper and functional-layer upper are joined to an injection-molded sole.

21. A method for manufacturing a waterproof, water vapor permeable shoe, comprising the steps:

manufacturing an exterior upper;

manufacturing a waterproof, water vapor permeable functional-layer upper in the shape of a sock;

manufacturing a lining upper, comprised of shaped individual pieces sewn together at seams, in the shape of a sock;

inserting the functional-layer upper into the exterior upper;

inserting the lining upper into the functional-layer upper; and applying a sole from underneath, wherein the seams of the lining upper that join the shaped individual pieces of the lining upper join only the shaped individual pieces of the lining upper and do not join the lining upper with the functional-layer upper.

22. The method according to claim 21, wherein the inside of the functional-layer upper has glue points through which the functional-layer upper is joined to the lining upper after inserting the functional-layer into the exterior upper and the lining upper into the functional-layer upper.

* * * * *

UNITED STATES PATENT AND TRADEMARK OFFICE

CERTIFICATE OF CORRECTION

PATENT NO. : 6,698,108 B2
DATED : March 2, 2004
INVENTOR(S) : Liviu Pavelescu et al.

It is certified that error appears in the above-identified patent and that said Letters Patent is hereby corrected as shown below:

Column 5,
Line 56, change “5,678,236” to -- 5,678,326 --.

Column 6,
Line 8, change “polyethylene, terephthalate” to -- polyethylene terephthalate --.

Signed and Sealed this

Fourteenth Day of December, 2004

JON W. DUDAS
*Director of the United States Patent and Trademark Office*